United States Patent [19]

Kelsey

[11] 3,962,976

[45] June 15, 1976

[54] COMPOSITE ARMOR STRUCTURE

[75] Inventor: Ronald A. Kelsey, New Kensington, Pa.

[73] Assignee: Aluminum Company of America, Pittsburgh, Pa.

[22] Filed: Aug. 16, 1971

[21] Appl. No.: 172,132

[52] U.S. Cl. ..... 109/82; 89/36 A; 428/911

[51] Int. Cl.[2] ..... F41H 5/04

[58] Field of Search ..... 89/36 R, 36 A, 36 H; 109/82, 83, 84, 85; 161/186, 213–217, 404; 29/197.5

[56] References Cited

UNITED STATES PATENTS

| | | | |
|---|---|---|---|
| 2,279,110 | 4/1942 | Collins | 89/36 A |
| 3,042,555 | 7/1962 | George et al. | 109/85 |
| 3,157,090 | 11/1964 | Ballu | 89/36 A |
| 3,382,136 | 5/1968 | Bugel et al. | 161/216 |
| 3,392,045 | 7/1968 | Holub | 161/186 |
| 3,450,595 | 6/1969 | Salter et al. | 161/215 |
| 3,455,775 | 7/1969 | Pohl et al. | 161/216 |
| 3,559,221 | 2/1971 | Juhnke | 161/186 |
| 3,649,227 | 3/1972 | Fetzer | 29/197.5 |

FOREIGN PATENTS OR APPLICATIONS

| | | | |
|---|---|---|---|
| 12,957 | 1915 | United Kingdom | 89/36 A |

*Primary Examiner*—Stephen C. Bentley
*Attorney, Agent, or Firm*—Arnold B. Silverman

[57] ABSTRACT

A composite armor structure which resists passage of armor piercing projectiles and shell fragments therethrough and also resists rearward discharge of spalled material from the armor structure. A frontal plate composed of a high tensile strength aluminum alloy having an ultimate tensile strength greater than 70 ksi. A backup plate composed of an intermediate tensile strength aluminum alloy having an ultimate tensile strength of about 30 to 70 ksi. A non-metallic filler material interposed between the frontal plate and backup plate. The non-metallic filler material may be selected from the group consisting of epoxies, phenolics, polyesters, polycarbonates and high density polyvinyls.

6 Claims, 3 Drawing Figures

COMPOSITE ARMOR STRUCTURE

BACKGROUND OF THE INVENTION

1. Field of the Invention

This invention relates to a composite armor structure which is adapted to prevent penetration of projectiles and resist rearwardly directed spalling of portions of the armor material. More specifically, the composite armor structure of this invention is adapted to provide effective resistance to shell fragment penetration, while preventing such spalling and providing significant weight saving advantages.

2. Description of the Prior Art

Various forms of composite armor structure which are suitable for effectively resisting penetration by armor piercing projectiles have been known. Many of these structures employ multiple layers of metal armor components with or without interposed non-metallic materials. See U.S. Pat. Nos. 3,157,090, 3,179,553, 3,351,374, 3,431,818 and 3,516,898. Some of these prior disclosures involve structures which provide specifically configurated deflecting elements which are interposed between interior and exterior plate-like elements. Others rely upon selection of a specific combination of materials which are adapted to function in the desired fashion.

While there have been numerous armor composite structures which effectively resist penetration of armor projectiles therethrough, there remains the problem of undesired and potentially hazardous spalling of armor materials resulting from impact by shell fragments. Also, many high strength armor structures which possess good resistance to penetration by armor piercing projectiles have inferior resistance to attack by shell fragments. There remains, therefore, a need for a composite armor structure which will effectively resist penetration by shell fragments, as determined by ballistic tests with fragment simulating projectiles (MIL-P-46593A ORD), and also prevent undesired rearward discharge of spalled materials.

SUMMARY OF THE INVENTION

The above described need has been filled by the composite armor structure of this invention. The structure employs a frontal plate which is composed of high tensile strength aluminum alloy having ultimate tensile strength greater than 70 ksi (kilopounds per square inch). A backup plate is composed of an intermediate tensile strength aluminum alloy having ultimate tensile strength from about 30 to 70 ksi. A non-metallic filler material is interposed between the frontal plate and backup plate and preferably is substantially continuous and coextensive therewith. The filler material is preferably selected from the group consisting of epoxies, phenolics, polyesters, polycarbonates and high density polyvinyls. The frontal plate preferably has a thickness of about one-fourth to two times that of the backup plate.

It is an object of this invention to provide a composite armor structure which is adapted to resist penetration of shell fragments in addition to other ballistic projectiles while effectively resisting undesired spalling.

It is another object of the invention to provide such a composite armor structure employing two specifically selected aluminum alloy plate components which will result in a composite structure which has reduced weight and occupies reduced volume with respect to structures having similar performance characteristics.

It is another object of this invention to provide such a composite armor structure wherein a hard non-metallic filler material is interposed between the frontal plate and backup plate.

It is another object of this invention to provide a composite armor structure which may be economically fabricated and which is of such size and weight as to be adapted to be advantageously employed in armor vehicles.

It is yet another object of this invention to provide a material for the backup plate which is readily weldable so that it may be used as the basic hull structure of the vehicle.

These and other objects of the invention will be more fully understood from the following description of the invention on reference to the illustrations appended hereto.

DESCRIPTION OF THE PREFERRED EMBODIMENT

The term "aluminum" as used herein refers to any grade of aluminum and aluminum base alloys wherein aluminum consists of not less than 80% by weight of the total composition.

As used herein the term "high tensile strength aluminum alloy" and words of similar import shall refer to an aluminum base alloy having an ultimate tensile strength greater than 70 ksi (kilopounds per square inch). The term "intermediate tensile strength aluminum alloys" and words of similar import shall refer to an aluminum base alloy having an ultimate tensile strength of about 30 to 70 ksi (kilopounds per square inch).

Figure 1:
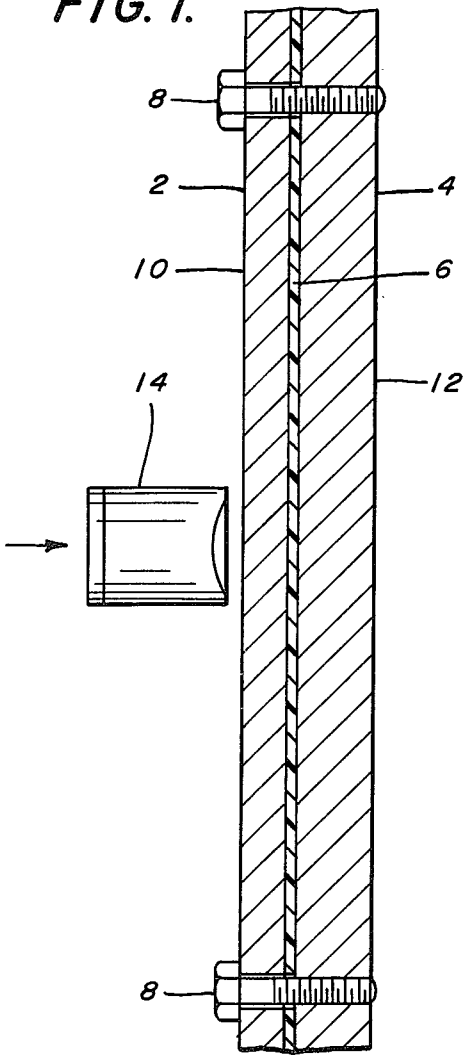
FIG. 1 is a cross-sectional view of the composite armor structure of this invention showing a fragment simulation projectile about to contact the armor structure.

Referring now more specifically to FIG. 1, it is seen that the composite armor structure illustrated has a frontal plate 2, a backup plate 4 and an interposed filler material 6. Although the filler material 6 may serve as an adhesive to hold the two plates together, suitable fastening means, which in the form shown are bolts 8, are preferably employed to secure the assembly. The materials of the composite armor structure of this invention have been specifically selected in order to provide suitable resistance to penetration by armor piercing projectiles and shell fragments, while resisting undesired rearward discharge of spalled material from the composite armor structure. The frontal plate 2 of this invention is composed of a high tensile strength aluminum alloy which effectively resists penetration of armor piercing projectiles and shell fragments therethrough. The frontal plate 2 preferably has a substantially uniform thickness and a generally flat exterior exposed surface 10.

The backup plate of this invention is preferably composed of a tough aluminum alloy which has an intermediate tensile strength and is capable of absorbing a substantial amount of impact energy without tearing or cracking. These characteristics will permit the backup plate 4 to undergo more substantial amounts of uniform deformation prior to the initiation of cracking. The backup plate 4 preferably has a substantially uniform thickness and a generally flat rearwardly exposed surface 12.

Tests have shown that small gaps between the frontal plate 2 and backup plate 4 such as those caused by normal out-of-flatness lower the ballistic resistance of the composite armor to fragment simulation projectiles. It has been determined that the use of a suitable non-metallic filler material 6, which is preferably substantially continuous and generally coextensive with frontal plate 2 and backup plate 4, provides increased resistance to projectile penetration. It is preferred that the filler material 6 be selected from the group consisting of epoxies, phenolics, polyesters, polycarbonates and high density polyvinyls. It has been found that the absence of a suitable filler material from the gap between the frontal plate 2 and backup plate 4 can result in a reduction of projectile velocity required for penetration of the composite armor by about 100 to 200 feet per second. It has also been found that a thin layer of a tough plastic material (not shown), such as urethane, may be beneficial if positioned at the rear face of the backup plate 4.

Among the specific materials which are most advantageously employed in the frontal plate 2 are the aluminum-zinc alloys. Aluminum alloys which are designated 7075 and 7178 have been found to function well in this use and are particularly effective in the T6 tempers. Among the aluminum alloys found to be particularly suitable for use in the backup plate 4 are aluminum-magnesium alloys, and aluminum-magnesium silicon alloys, and also to a slightly lesser extent copper-free aluminum-zinc-magnesium alloys. Particularly fine results have been obtained with the alloys designated 5083 and 5456, with increased effectiveness being provided when the alloys are employed in the H117 tempers.

Figure 3:
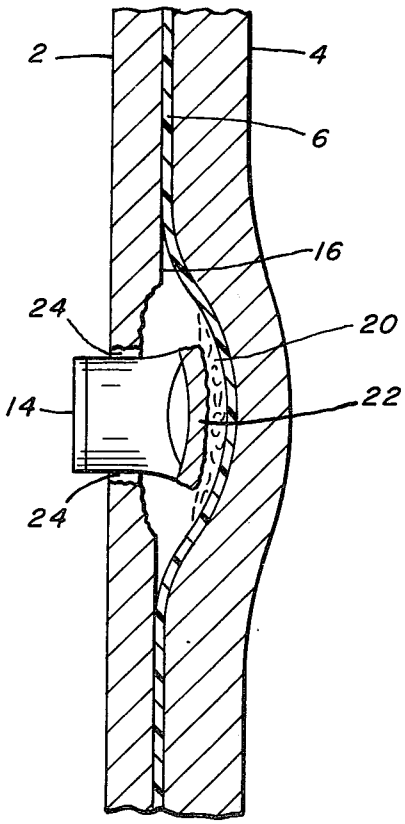
FIG. 3 is similar to FIG. 2, but illustrates the composite structure after termination of projectile penetration.
Figure 2:
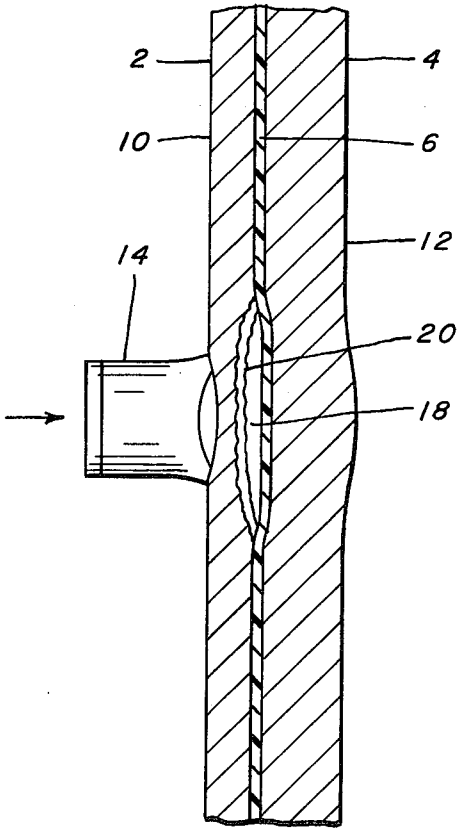
FIG. 2 is a cross-sectional illustration similar to FIG. 1, but illustrates the composite structure after impact of the projectile.

Referring now more specifically to FIG. 2, it is noted that the shell fragment 14 (shown as approaching the frontal plate 2 in the direction indicated by the arrow) has made contact with the frontal plate 2 and has penetrated through the exteriorly exposed surface 10. It is noted that when the projectile 14 upon the frontal plate 2, the leading portion of the projectile 14 is flattened. Also, shock waves developed by the impact cause material to spall off from the rear surface of the frontal plate 2 and create rearwardly open spalling recess 18. Tests have shown that the thickness and diameter of the spall is larger when the two plates are in intimate contact or, if intimate contact is not possible because of out-of-flatness of the plates, when a filler is used between the plates. It will be noted in FIG. 2 that because of the presence of the backup plate the spall 20 is not ejected from the rear of the frontal plate as a secondary projectile, but is restrained by the backup plate 4. Now referring to FIG. 3, it is seen that because of the increased cross sectional area of the projectile due to flattening at impact, the projectile must displace a larger plug of the frontal plate 2 in order to create opening 24 than would be the case if it had not been flattened. This results in an increase in the energy required to shear out the plug, which, in turn, results in a greater deceleration of the projectile than would occur if the projectile were not flattened. Finally, the projectile, plug 22 and spall 20 combine to form a "projectile" which must now penetrate the backup plate 4. Because the backup plate 4 has high toughness, it can undergo considerable deformation before failure through either ejecting a plug or by cracking. This contributes to further slowing down of the projectile. In this fashion, not only is the projectile effectively prevented from passing entirely through the composite armor structure, but also undesired and potentially dangerous rearward spalling has been eliminated.

With the present structure employing the above described materials, there is a substantial weight saving as compared with a solid unitary composite or metal armor structure. This results in part from the substitution of the filler material 6 for what otherwise might be either solid metal or a void space which would be greatly inferior in terms of penetration resistance. It is also noted that the selection of the two specific aluminum alloys having unique properties when combined in the armor assembly may result in a meaningful reduction of volume of space occupied by the composite armor structure. Not only do the weight and volume savings become meaningful in ordinary usage, but such characteristics render the structure uniquely suited to use in armored vehicles.

In the prefered form of the invention the frontal plate 2 will have a thickness of about ¼ to 2 times that of the thickness of the backup plate 4. The overall combined thickness of the composite structure might range from about ½ inch to 2 inches, depending upon the magnitude of the ballistic threat to be defended against by the composite structure.

While for purposes of illustration assembly securing means in the form of bolts 8 have been illustrated, it will be appreciated that other forms of joining means such as other mechanical fasteners, welding or adhesives may effectively be employed.

EXAMPLE 1

A composite armor structure within this invention may be made by providing a frontal plate composed of a 7075-T6 alloy having a minimum ultimate tensile strength of 84 ksi. A backup plate may be composed of a 5456-H117 alloy which has a minimum ultimate tensile strength of 46 ksi. An epoxy filler may be interposed between the two plates to provide a substantially coextensive filler element. Bolts may be employed to mechanically secure the assembly. Tests of such structures have indicated that regardless of whether the angle of impingement of the shell fragment is perpendicular to the surface of the frontal plate or angular with respect to the surface thereof the performance of this impact absorbing structure is equal that of a homogeneous aluminum alloy armor plate having a weight per square foot which is 25% greater than the present structure.

EXAMPLE 2

A composite armor structure within this invention was made with a frontal plate consisting of a 7178-T6 alloy having a 5/16 inch thickness and a backup plate of 5456-H321 alloy having a ½ inch thickness. An epoxy filler was interposed between the plates. The composite was tested by the U.S. Army at Aberdeen Proving Ground against a 105 mm H.E. shell. The tests showed that the composite armor had a resistance against penetration by shell fragments comparable to that of an aluminum alloy armor plate having a weight per square foot 30% greater than the composite armor.

It will, therefore, be appreciated that the composite armor structure of this invention is effective to resist armor piercing projectile or shell fragment penetration, while also resisting undesired and potentially hazardous rearward discharge of spalled material from the composite armor structure. All of this is accomplished by providing certain specific alloy materials in the frontal and backup plates and a hard interposed filler material. The advantageous results of this invention render the structure uniquely suitable for use in an armored vehicle as a result of substantial savings in terms of a meaningful reduction in weight and volume occupied by the composite armor structure. A proportionate cost savings is also facilitated by use of this structure.

Whereas particular embodiments of this invention have been described above for purposes of illustration, it will be apparent to those skilled in the art that numerous variations of the details may be made without departing from the invention as defined in the appended claims.

I claim:

1. A composite armor structure comprising a frontal plate composed of an aluminum-zinc alloy having an ultimate tensile strength greater than 70 ksi, a backup plate composed of an aluminum-magnesium alloy having an ultimate tensile strength of about 30 to 70 ksi, a non-metallic filler material interposed between said frontal plate and said backup plate, and said filler material being selected from the group consisting of epoxies, phenolics, polyesters, polycarbonates and high density polyvinyls, whereby said composite armor structure resists passage of shell fragments therethrough and resists rearward discharge of spalled material upon frontal plate impact by a projectile.

2. The composite armor structure of claim 1 including means securing said frontal plate to said backup plate with said filler material secured therebetween, and said frontal plate has a thickness of about one-fourth to two times that of the thickness of said backup plate.

3. The composite armor structure of claim 2 including said frontal plate is selected from the group consisting of 7075 and 7178, and said backup plate is composed of an alloy selected from the group consisting of 5083 and 5456.

4. The composite armor structure of claim 3 including said frontal plate aluminum alloy is in the T6 temper, and said backup plate aluminum alloy is in the H117 temper.

5. The composite armor structure of claim 4 including said frontal plate has a forwardly exposed substantially flat surface, said backup plate has a rearwardly exposed substantially flat surface, and said substantially flat plate surfaces are disposed generally parallel with respect to each other.

6. The composite armor structure of claim 5 including said filler material is substantially continuous and generally coextensive with said frontal plate and said backup plate.

* * * * *